US009020154B2

(12) United States Patent
Hartung et al.

(10) Patent No.: US 9,020,154 B2
(45) Date of Patent: Apr. 28, 2015

(54) MULTI-ELEMENT ELECTROACOUSTICAL TRANSDUCING

(75) Inventors: Klaus Hartung, Hopkinton, MA (US); Roman Katzer, Esslingen (DE)

(73) Assignee: Bose Corporation, Framingham, MA (US)

( * ) Notice: Subject to any disclaimer, the term of this patent is extended or adjusted under 35 U.S.C. 154(b) by 1046 days.

(21) Appl. No.: 12/771,541

(22) Filed: Apr. 30, 2010

(65) Prior Publication Data

US 2010/0232617 A1 Sep. 16, 2010

Related U.S. Application Data

(63) Continuation-in-part of application No. 11/499,014, filed on Aug. 4, 2006, now abandoned.

(60) Provisional application No. 61/174,726, filed on May 1, 2009.

(51) Int. Cl.

| | |
|---|---|
| ***H04R 29/00*** | (2006.01) |
| ***H04S 1/00*** | (2006.01) |
| ***G10K 11/178*** | (2006.01) |

(52) U.S. Cl.

CPC ..... *H04S 1/002* (2013.01); *G10K 11/178* (2013.01); *G10K 2210/106* (2013.01); *G10K 2210/1282* (2013.01); *G10K 2210/1291* (2013.01); *H04R 2205/022* (2013.01); *H04S 2400/09* (2013.01)

(58) Field of Classification Search

USPC ..... 381/58, 59, 71.1, 71.2, 71.7, 71.8, 71.9, 381/89, 96, 111, 116, 113, 87; 73/1.37, 73/1.01, 861.18, 861, 488; 702/142, 127, 702/196; 708/520, 490, 200, 100

See application file for complete search history.

(56) References Cited

U.S. PATENT DOCUMENTS

| | | | | |
|---|---|---|---|---|
| 2,872,516 | A | | 2/1959 | Hoffman |
| 4,146,744 | A | | 3/1979 | Veranth |
| 4,146,745 | A | | 3/1979 | Froeschle et al. |
| 4,162,372 | A | | 7/1979 | Gross et al. |
| 4,238,746 | A | * | 12/1980 | McCool et al. ..... 333/166 |
| 5,216,721 | A | * | 6/1993 | Melton ..... 381/71.11 |
| 5,461,676 | A | | 10/1995 | Hobelsberger |
| 5,475,761 | A | | 12/1995 | Eatwell |

(Continued)

FOREIGN PATENT DOCUMENTS

| | | |
|---|---|---|
| EP | 0847225 | 6/1998 |
| EP | 1713305 A1 | 10/2006 |
| WO | 2005062671 A1 | 7/2005 |

OTHER PUBLICATIONS

International Search Report and Written Opinion dated Dec. 13, 2007 for PCT/USO7/074336.

(Continued)

*Primary Examiner* — Vivian Chin
*Assistant Examiner* — Con P Tran
(74) *Attorney, Agent, or Firm* — Bose Corporation

(57) ABSTRACT

An acoustic apparatus including circuitry to correct for acoustic cross-coupling of acoustic drivers mounted in a common acoustic enclosure. A plurality of acoustic drivers are mounted in the acoustic enclosure so that motion of each of the acoustic drivers causes motion in each of the other acoustic drivers. A canceller cancels the motion of each of the acoustic drivers caused by motion of each of the other acoustic drivers. A cancellation adjuster cancels the motion of each of the acoustic drivers that may result from the operation of the canceller.

9 Claims, 7 Drawing Sheets

(56) References Cited

U.S. PATENT DOCUMENTS

| | | | |
|---|---|---|---|
| 5,627,896 | A | 5/1997 | Southward et al. |
| 6,275,580 | B1 | 8/2001 | Faraci et al. |
| 2008/0031472 | A1 | 2/2008 | Freeman et al. |

OTHER PUBLICATIONS

International Preliminary Report on Patentability dated Sep. 1, 2008 for Appl. No. PCT/US2007/074336.

Third Chinese Office Action dated Nov. 5, 2012 for Chinese Application No. 200780027532.2.

Second Chinese Office Action dated Mar. 26, 2012 for Chinese Application No. 200780027532.2.

CN Office Action dated Jun. 24, 2013 for CN 200780027532.2.

CN Office Action dated Oct. 11, 2013 for CN 200780027532.2.

International Search Report and Written Opinion dated Jul. 28, 2010 for Int. Appln. No. PCT/US2010/033212.

* cited by examiner

MULTI-ELEMENT ELECTROACOUSTICAL TRANSDUCING

CLAIM OF PRIORITY

This application is a continuation-in-part of, and claims priority to, U.S. patent application Ser. No. 11/499,014 filed Aug. 4, 2006 and published Feb. 7, 2008 as published Pat. App. US-2008-0031472-A1 and also claims priority to U.S. Provisional Patent App. 61/174,726, filed May 1, 2009.

BACKGROUND

This specification describes a loudspeaker system in which two or more acoustic drivers share a common enclosure.

SUMMARY

In one aspect, an apparatus includes an acoustic enclosure, a plurality of acoustic drivers mounted in the acoustic enclosure so that motion of each of the acoustic drivers causes motion in each of the other acoustic drivers, a canceller, to cancel the motion of each of the acoustic drivers caused by motion of each of the other acoustic drivers, and a cancellation adjuster, to cancel the motion of each of the acoustic drivers that may result from the operation of the canceller. The cancellation adjuster may adjust for undesirable phase and frequency response effects that result from the operation of the canceller. The cancellation adjuster may apply the transfer function matrix $$\begin{bmatrix} H_{11} & \dots & H_{1n} \\ & \vdots & \\ H_{1n} & \dots & H_{nn} \end{bmatrix}$$

where each of the matrix elements $H_{xy}$ represents a transfer function from an audio signal $V_x$ applied to the input of acoustic driver x to motion represented by velocity $S_y$ of acoustic driver y. The acoustic drivers may be a components of a directional array. The acoustic drivers may be components of a two-way speaker.

In another aspect, a method of operating a loudspeaker having at least two acoustic drivers in a common enclosure, includes determining the effect of the motion of a first acoustic driver on the motion of a second acoustic driver; developing a first correction audio signal to correct for the effect of the motion of the first acoustic driver on the motion of the second acoustic driver; determining the effect on the motion of the first acoustic driver of the transducing of the correction audio signal by the second acoustic driver; and developing a second correction audio signal to correct for the effect on the motion of the first acoustic driver of the transducing of the first correction audio signal by the second acoustic driver. The correction audio signal may correct the frequency response and the phase effects on the motion of the first acoustic driver of the transducing of the correction audio signal by the second acoustic driver. The second correction audio signal may be $$\frac{1}{\det H},$$

where H is the transfer function matrix $$\begin{bmatrix} H_{11} & \dots & H_{1n} \\ & \vdots & \\ H_{1n} & \dots & H_{nn} \end{bmatrix}$$

where the matrix elements $H_{xy}$ represent the transfer function from an audio signal $V_x$ applied to the input of acoustic driver x to motion represented by velocity $S_y$ of acoustic driver y.

The method may further include determining matrix elements $H_{xy}$ by causing acoustic driver y to transduce an audio signal, and measuring the effect on acoustic driver x of the transducing by acoustic driver y by a laser vibrometer. The method of claim 8, wherein the motion of acoustic driver is represented by a displacement.

DETAILED DESCRIPTION

Figure 1A:
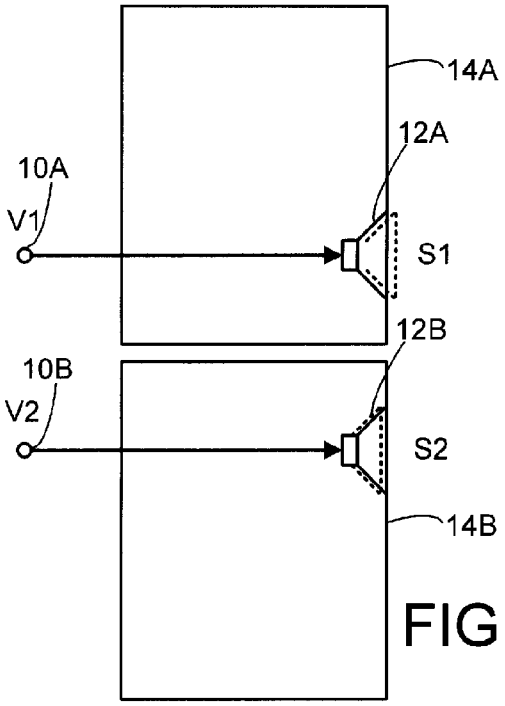
FIGS. 1A-1D are block diagrams of an audio system.

Though the elements of several views of the drawing are shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Unless otherwise indicated, audio signals may be encoded in either digital or analog form. For convenience, "radiating sound waves corresponding to channel x" will be expressed as "radiating channel x."

Referring to FIG. 1A, there is shown a block diagram of an acoustic system. Audio signal source 10A is coupled to acoustic driver 12A that is mounted in enclosure 14A. Audio signal source 10B is coupled to acoustic driver 12B that is mounted in enclosure 14B. Acoustic enclosure 14A is acoustically and mechanically isolated from acoustic enclosure 14B. Driving acoustic driver 12A by an audio signal represented by voltage $V_1$ results in desired motion $S_1$ which results in the radiation of acoustic energy. The motion can be expressed as a velocity or a displacement; for convenience, the following explanation will express motion as a velocity. Driving acoustic driver 12B by an audio signal represented by voltage $V_2$ results in desired motion $S_2$.

Figure 1B:
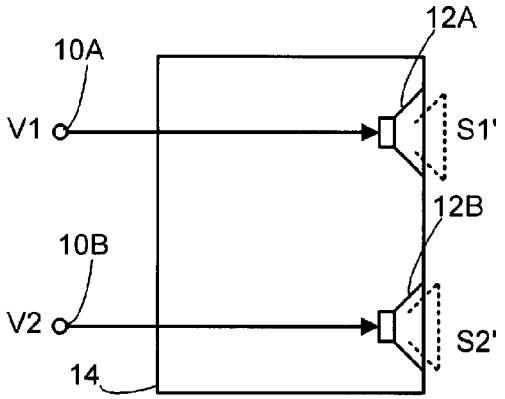

In the audio system of FIG. 1B, audio signal source 10A is coupled to acoustic driver 12A. Audio signal source 10B is coupled to acoustic driver 12B. Acoustic drivers 12A and 12B are mounted in enclosure 14, which has the same volume as enclosures 14A and 14B. Driving acoustic driver 12A by an audio signal represented by voltage $V_1$ results in motion $S_1'$ which may not be equal to desired motion $S_1$ because of acoustic cross-coupling, either through the air volume in the shared enclosure or mechanical coupling through the shared enclosure, or both. Similarly, driving acoustic driver 12B by an audio signal represented by voltage $V_2$ results in motion $S_2'$ which may not be equal to desired motion $S_2$.

Figure 1C:
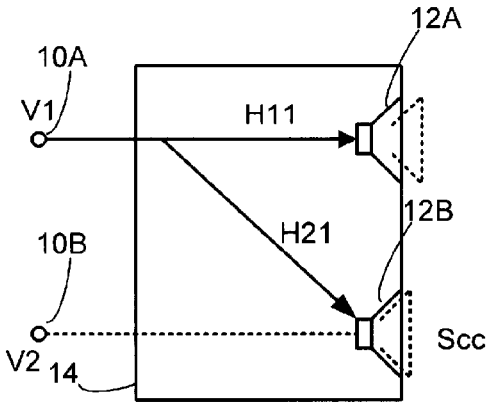
Figure 1D:
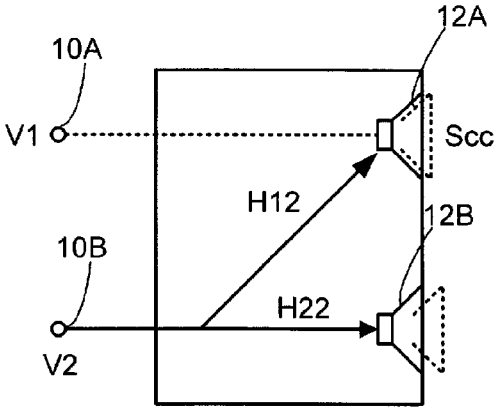

The effect of cross-coupling can be seen in FIG. 1C, in which applying an acoustic signal represented by voltage $V_1$ to acoustic driver 12A and applying no signal (indicated by the dashed line between audio signal source 10B and acoustic driver 12B) to acoustic driver 12B results in cross-coupling induced motion $S_{cc}$ of acoustic driver 12B. In FIG. 1D, applying an acoustic signal represented by voltage $V_2$ to acoustic driver 12B and applying no signal (indicated by the dashed line between audio signal source 10A and acoustic driver 12A) to acoustic driver 12A results in cross-coupling induced motion $S_{cc}$ of acoustic driver 12A. For the purpose of the explanations following, transfer function $H_{11}$ is the transfer function from voltage $V_1$ to velocity $S_1$, transfer function $H_{12}$ is the transfer function from voltage $V_2$ to velocity $S_1$, transfer function $H_{21}$ is the transfer function from voltage $V_1$ to velocity $S_2$, and transfer function $H_{22}$ is the transfer function from voltage $V_2$ to velocity $S_2$. In the explanations that follow, an acoustic driver with an audio signal applied (such as acoustic driver 12A of FIG. 1C and acoustic driver 12B of FIG. 1D) will be referred to as a "primary acoustic driver"; an acoustic driver without a signal applied (for example acoustic driver 12B of FIG. 1C and acoustic driver 12A of FIG. 1D) that moves responsive to an audio signal being applied to a primary acoustic driver will be referred to as a "secondary acoustic driver".

Figure 2:
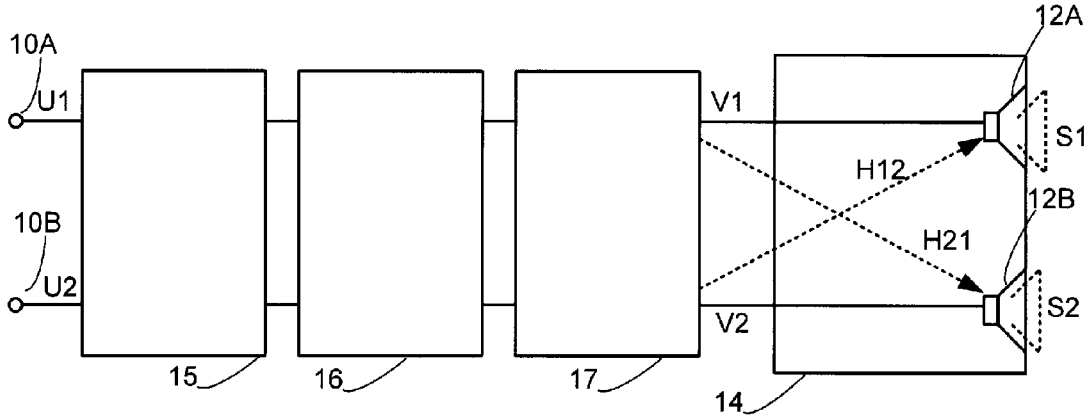
FIG. 2 is a block diagram of an audio system having cross-coupling canceller and a cancellation adjuster.

FIG. 2 includes the elements of FIG. 1B, and in addition includes a canceller 16, cancellation adjuster 15, and conventional signal processor 17. The canceller 16 modifies the input audio signals $U_1$ and $U_2$ to cancel transfer function $H_{12}$ and transfer function $H_{21}$ (as indicated by the dashed lines) to provide modified signals $V_1$ and $V_2$ which result in the desired motion $S_1$ and $S_2$ of acoustic drivers 12A and 12B, respectively. The cancellation adjuster 15 adjusts the signal to cancel undesirable effects that may result from the operation of the canceller, such as effects on the phase or on the frequency response. The conventional signal processor 17 includes processing that is not related to cross-coupling cancellation, for example equalization for room effects; equalization for undesired effects on frequency response of the acoustic drivers, amplifiers, or other system components; time delays; array processing such as phase reversal or polarity inversions; and the like. Canceller 16, cancellation adjuster 15, and conventional signal processor 17 can be in any order. For clarity, conventional signal processor 17 will not be shown in subsequent figures.

Actual implementations of acoustic system of FIG. 2 is most conveniently performed by a digital signal processor.

Figure 3:
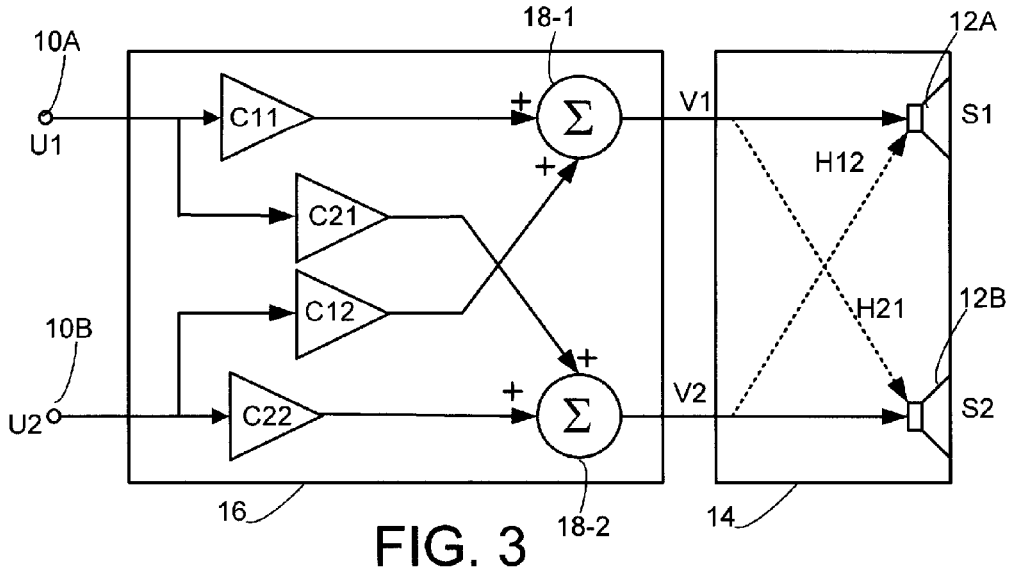
FIG. 3 is a block diagram of an audio system showing elements of the canceller.

FIG. 3 shows the canceller 16 in more detail; cancellation adjuster 15 is not shown in this view and will be discussed below. Canceller 16 includes canceling transfer function $C_{11}$ coupling signal $U_1$ and summer 18A, canceling transfer function $C_{21}$ coupling signal $U_1$ and summer 18B, canceling transfer function $C_{22}$ coupling signal $U_2$ and summer 18B, canceling transfer function $C_{12}$ coupling signal $U_2$ and summer 18A. Summer 18A is coupled to acoustic driver 12A and summer 18B is coupled to acoustic driver 12B.

Canceling transfer functions $C_{11}$, $C_{21}$, $C_{22}$, and $C_{12}$ can be derived as follows. The relationships of FIGS. 1C and 1D can be expressed mathematically as $$H_{11}\cdot V_1+H_{12}\cdot V_2=S_1$$

$$H_{21}\cdot V_1+H_{22}\cdot V_2=S_2$$

The notation can be simplified by transforming this set of linear equations into matrix form. The transfer function matrix H contains all transmission paths in the system:

$$H=\begin{bmatrix} H_{11} & H_{12} \\ H_{21} & H_{22} \end{bmatrix}$$

The input voltages are grouped into a vector v and the velocity or displacement into a vector S. In matrix notation, the system is described as $$\begin{bmatrix} H_{11} & H_{12} \\ H_{21} & H_{22} \end{bmatrix}\cdot\begin{pmatrix} V_1 \\ V_2 \end{pmatrix}=\begin{pmatrix} S_1 \\ S_2 \end{pmatrix}$$

Or simply $$H\cdot\vec{V}=\vec{S}$$

The relation between the input voltage and output voltage of the canceller is described by the linear equations:

$$C_{11}\cdot U_1+C_{12}\cdot U_2=V_1$$

$$C_{21}\cdot U_1+C_{22}\cdot U_2=V_2$$

Or in matrix notation $$\begin{bmatrix} C_{11} & C_{12} \\ C_{21} & C_{22} \end{bmatrix}\cdot\begin{pmatrix} U_1 \\ U_2 \end{pmatrix}=\begin{pmatrix} V_1 \\ V_2 \end{pmatrix}$$

$$C\cdot\vec{U}=\vec{V}$$

The velocities of the acoustic drivers can now be expressed as a function of the input voltages to the canceller.

$$H\cdot C\cdot\vec{U}=\vec{S}$$

$$\Leftrightarrow\begin{bmatrix} H_{11} & H_{12} \\ H_{21} & H_{22} \end{bmatrix}\cdot\begin{bmatrix} C_{11} & C_{12} \\ C_{21} & C_{22} \end{bmatrix}\cdot\begin{pmatrix} U_1 \\ U_2 \end{pmatrix}=\begin{pmatrix} S_1 \\ S_2 \end{pmatrix}$$

The overall system transfer function is described by the product of H and C. We can simplify this equation by defining a matrix T, which describes the entire system transfer function.

$$H\cdot C=T$$

With this, the equation of the input-output relationship of the system can be simplified to:

$$T\cdot\vec{U}=\vec{S}$$

$$\Leftrightarrow\begin{bmatrix} T_{11} & T_{12} \\ T_{21} & T_{22} \end{bmatrix}\cdot\begin{pmatrix} U_1 \\ U_2 \end{pmatrix}=\begin{pmatrix} S_1 \\ S_2 \end{pmatrix}$$

T also includes operations of conventional signal processor 17 and cancellation adjuster 15.

Assuming that the desired system transfer function T and the matrix H are known, the equation above can be solved for the canceller matrix C:

$$C=H^{-1}\cdot T$$

where $H^{-1}$ is the matrix inverse of H:

$$H^{-1} = \begin{bmatrix} H_{11} & H_{12} \\ H_{21} & H_{22} \end{bmatrix}^{-1} = \frac{1}{H_{11} \cdot H_{22} - H_{12} \cdot H_{21}} \cdot \begin{bmatrix} H_{22} & H_{12} \\ -H_{21} & H_{11} \end{bmatrix} = \frac{1}{\det H} \cdot \begin{bmatrix} H_{22} & -H_{12} \\ -H_{21} & H_{11} \end{bmatrix}$$

det H is the determinant of matrix H:

$$\det H = H_{11} \cdot H_{22} - H_{12} \cdot H_{21}$$

Written out in matrix notation:

$$\begin{bmatrix} C_{11} & C_{12} \\ C_{21} & C_{22} \end{bmatrix} = \frac{1}{\det H} \cdot \begin{bmatrix} H_{22} & -H_{12} \\ -H_{21} & H_{11} \end{bmatrix} \cdot \begin{bmatrix} T_{11} & T_{12} \\ T_{21} & T_{22} \end{bmatrix} = \frac{1}{\det H} \cdot \begin{bmatrix} T_{11} \cdot H_{22} - & T_{12} \cdot H_{22} - \\ T_{21} H_{12} & T_{22} \cdot H_{12} \\ -T_{11} \cdot H_{21} + & -T_{12} \cdot H_{21} + \\ T_{21} \cdot H_{11} & T_{22} \cdot H_{11} \end{bmatrix}$$

Thus, the coefficients of C are $$C_{11} = \frac{T_{11} \cdot H_{22} - T_{21} \cdot H_{12}}{\det H} \quad C_{12} = \frac{T_{12} \cdot H_{22} - T_{22} \cdot H_{12}}{\det H}$$

$$C_{21} = \frac{-T_{11} \cdot H_{21} + T_{21} \cdot H_{11}}{\det H} \quad C_{22} = \frac{-T_{12} \cdot H_{21} + T_{22} \cdot H_{11}}{\det H}$$

The denominators in these fractions are the same.

The concept described above with canceller matrix and target function can be universally applied to enclosures with more than two acoustic drivers. For a system with n acoustic drivers the transfer function from the electrical inputs to the velocities of the cones would be described by an n×n matrix. The elements on the main diagonal describe the actively induced cone motion. All other elements describe the acoustic cross-coupling between all cones. The equalization matrix will also be an n×n matrix.

It should be noted that this method can be applied to systems with different acoustic drivers, for example a loudspeaker system with a mid-range acoustic driver and a bass acoustic driver sharing the same acoustic volume. This will result in an asymmetric transfer function matrix but can be solved using the same methods.

The elements in the target function matrix can describe arbitrary responses, such as general equalizer functions. This also allows to control the relative amplitude and phase of all transducers (e.g. for acoustic arrays).

C can be calculated in either frequency or time domain. When the coefficients of the target matrix have been determined and the voltage to velocity or displacement transfer functions $H_{xx}$ have been measured, the coefficients of C are derived from those functions as described above.

Solving in the time domain always yields stable and causal filters. For this, the corresponding impulse responses for the matrix elements are determined. In this case, inverses of the impulse responses are determined by least-mean-squares (LMS) approximation. Information on LMS approximations can be found in Proakis and Manolakis, *Digital Signal Processing: Principles, Algorithms and Applications* Prentice Hall; 3rd edition (Oct. 5, 1995), ISBN-10: 0133737624, ISBN-13: 978-0133737622. The impulse responses can also be determined by other types of recursive filters.

The general solution for a 2×2 target matrix (a system with two acoustic drivers) is:

$$H \cdot C \cdot \vec{U} = \vec{S}$$

$$\Leftrightarrow \begin{bmatrix} H_{11} & H_{12} \\ H_{21} & H_{22} \end{bmatrix} \cdot \begin{bmatrix} C_{11} & C_{12} \\ C_{21} & C_{22} \end{bmatrix} \cdot \begin{pmatrix} U_1 \\ U_2 \end{pmatrix} = \begin{pmatrix} S_1 \\ S_2 \end{pmatrix}$$

$$\begin{bmatrix} C_{11} & C_{12} \\ C_{21} & C_{22} \end{bmatrix} = \frac{1}{\det H} \cdot \begin{bmatrix} H_{22} & -H_{12} \\ -H_{21} & H_{11} \end{bmatrix} \cdot \begin{bmatrix} T_{11} & T_{12} \\ T_{21} & T_{22} \end{bmatrix} = \frac{1}{\det H} \cdot \begin{bmatrix} T_{11} \cdot H_{22} - & T_{12} \cdot H_{22} - \\ T_{21} H_{12} & T_{22} \cdot H_{12} \\ -T_{11} \cdot H_{21} + & -T_{12} \cdot H_{21} + \\ T_{21} \cdot H_{11} & T_{22} \cdot H_{11} \end{bmatrix}$$

This is the same solution as described above.

Ideally, each acoustic driver's motion would be dependent on its corresponding input signal only. This would be represented as:

$$\begin{bmatrix} H_{11} & H_{12} \\ H_{21} & H_{22} \end{bmatrix} \cdot \begin{bmatrix} C_{11} & C_{12} \\ C_{21} & C_{22} \end{bmatrix} = \begin{bmatrix} T_{11} & 0 \\ 0 & T_{22} \end{bmatrix}$$

Only the diagonal elements of the target matrix are non-zero here.

The solution of this system is $$\begin{bmatrix} C_{11} & C_{12} \\ C_{21} & C_{22} \end{bmatrix} = \frac{1}{\det H} \cdot \begin{bmatrix} H_{22} & -H_{12} \\ -H_{21} & H_{11} \end{bmatrix} \cdot \begin{bmatrix} T_{11} & 0 \\ 0 & T_{22} \end{bmatrix} = \frac{1}{\det H} \cdot \begin{bmatrix} T_{11} \cdot H_{22} & -T_{22} \cdot H_{12} \\ -T_{11} \cdot H_{21} & T_{22} \cdot H_{11} \end{bmatrix}$$

Thus, the coefficients of C are $$C_{11} = \frac{T_{11} \cdot H_{22}}{\det H} \quad C_{12} = \frac{-T_{22} \cdot H_{12}}{\det H}$$

$$C_{21} = \frac{-T_{11} \cdot H_{21}}{\det H} \quad C_{22} = \frac{T_{22} \cdot H_{11}}{\det H}$$

Which can be expressed as:

$$C_{11} = \frac{1}{\det H} \cdot T_{11} \cdot H_{22}$$

$$C_{12} = \frac{1}{\det H} \cdot T_{22} \cdot (-H_{12})$$

$$C_{21} = \frac{1}{\det H} \cdot T_{11} \cdot (-H_{21})$$

$$C_{22} = \frac{1}{\det H} \cdot T_{22} \cdot H_{11}$$

Figure 4:
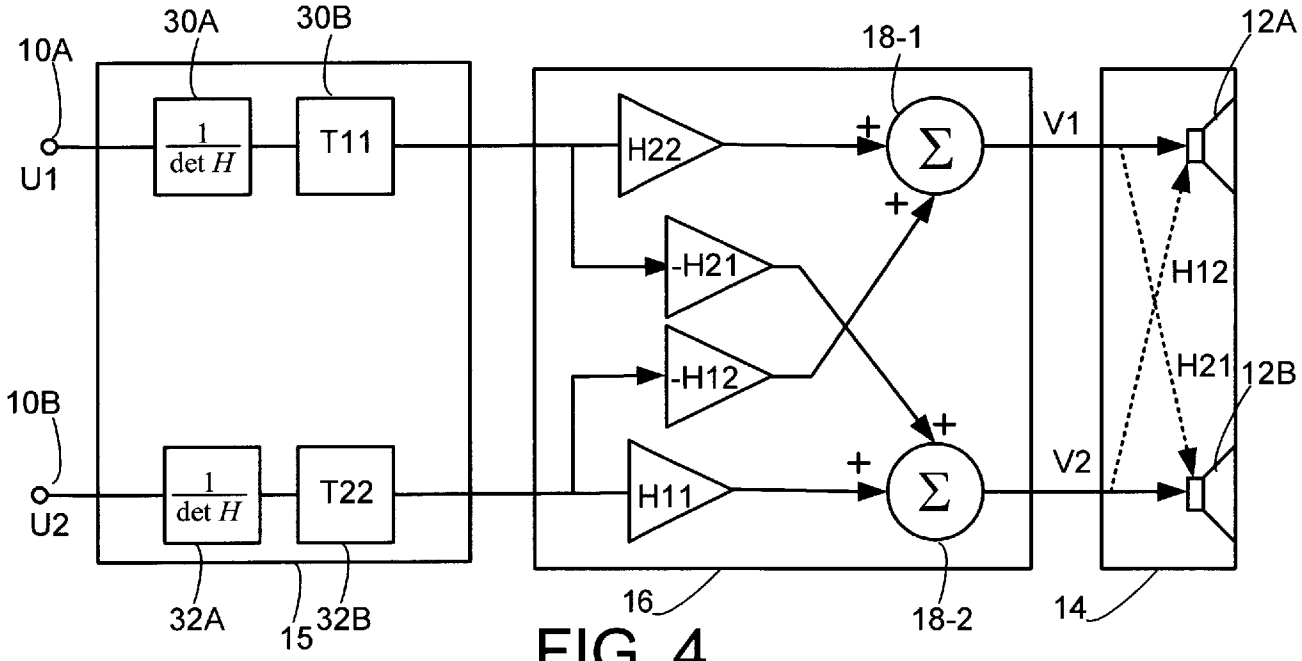
FIG. 4 is a block diagram of an audio system showing elements of the canceller and the cancellation adjuster.

Common coefficients can be moved out of the canceller system, leaving coefficients that are different from unity only in the cross-paths. Referring to FIG. 4, the operations represented by transfer functions 30A and 32A, and 30B, and 32B comprise the operations performed by cancellation adjuster 15. In other implementations, elements 30B and 32B (the target transfer functions elements $T_{11}$–$T_{mn}$), may be applied by the canceller 16. Performing transfer function elements $T_{11}$–$T_{nn}$ in either the cancellation adjuster 15 or the canceller 16 means that signal processing not related to cross-coupling, for example, for example equalization for room effects, equalization for undesired effects on frequency response of the acoustic drivers, amplifiers, or other system components, time delays, array processing such as phase reversal or polarity inversions, and the like can be done by the canceller 16 or the cancellation adjuster 15, which eliminates the need for the conventional signal processor 17 of FIG. 2.

If both acoustic drivers are driven by a single input (for example in a directional array), the elements of the second column in T are zero because the array is only driven by one input:

$$\begin{bmatrix} H_{11} & H_{12} \\ H_{21} & H_{22} \end{bmatrix} \cdot \begin{bmatrix} C_{11} & C_{12} \\ C_{21} & C_{22} \end{bmatrix} = \begin{bmatrix} T_{11} & 0 \\ T_{21} & 0 \end{bmatrix}$$

The solution is $$\begin{bmatrix} C_{11} & C_{12} \\ C_{21} & C_{22} \end{bmatrix} = \frac{1}{\det H} \cdot \begin{bmatrix} H_{22} & -H_{12} \\ -H_{21} & H_{11} \end{bmatrix} \cdot \begin{bmatrix} T_{11} & 0 \\ T_{21} & 0 \end{bmatrix} = \frac{1}{\det H} \cdot \begin{bmatrix} T_{11} \cdot H_{22} - T_{21} \cdot H_{12} & 0 \\ -T_{11} \cdot H_{21} + T_{21} \cdot H_{11} & 0 \end{bmatrix}$$

The elements of C are $$C_{11} = \frac{T_{11} \cdot H_{22} - T_{21} \cdot H_{12}}{\det H} \quad C_{12} = 0$$

$$C_{21} = \frac{-T_{11} \cdot H_{21} + T_{21} \cdot H_{11}}{\det H} \quad C_{22} = 0$$

A special case of this operating mode is stopping the motion of the second cone, as described previously. In this case, $T_{21}$ is also 0. The elements of C are $$C_{11} = \frac{T_{11} \cdot H_{22}}{\det H} \quad C_{12} = 0$$

$$C_{21} = \frac{-T_{11} \cdot H_{21}}{\det H} \quad C_{22} = 0$$

In this case, the term $$\frac{T_{11}}{\det H}$$

is common to both elements and can be moved out in front of the system, leaving only $H_{22}$ and $-H_{21}$ as filter terms.

Figure 5:
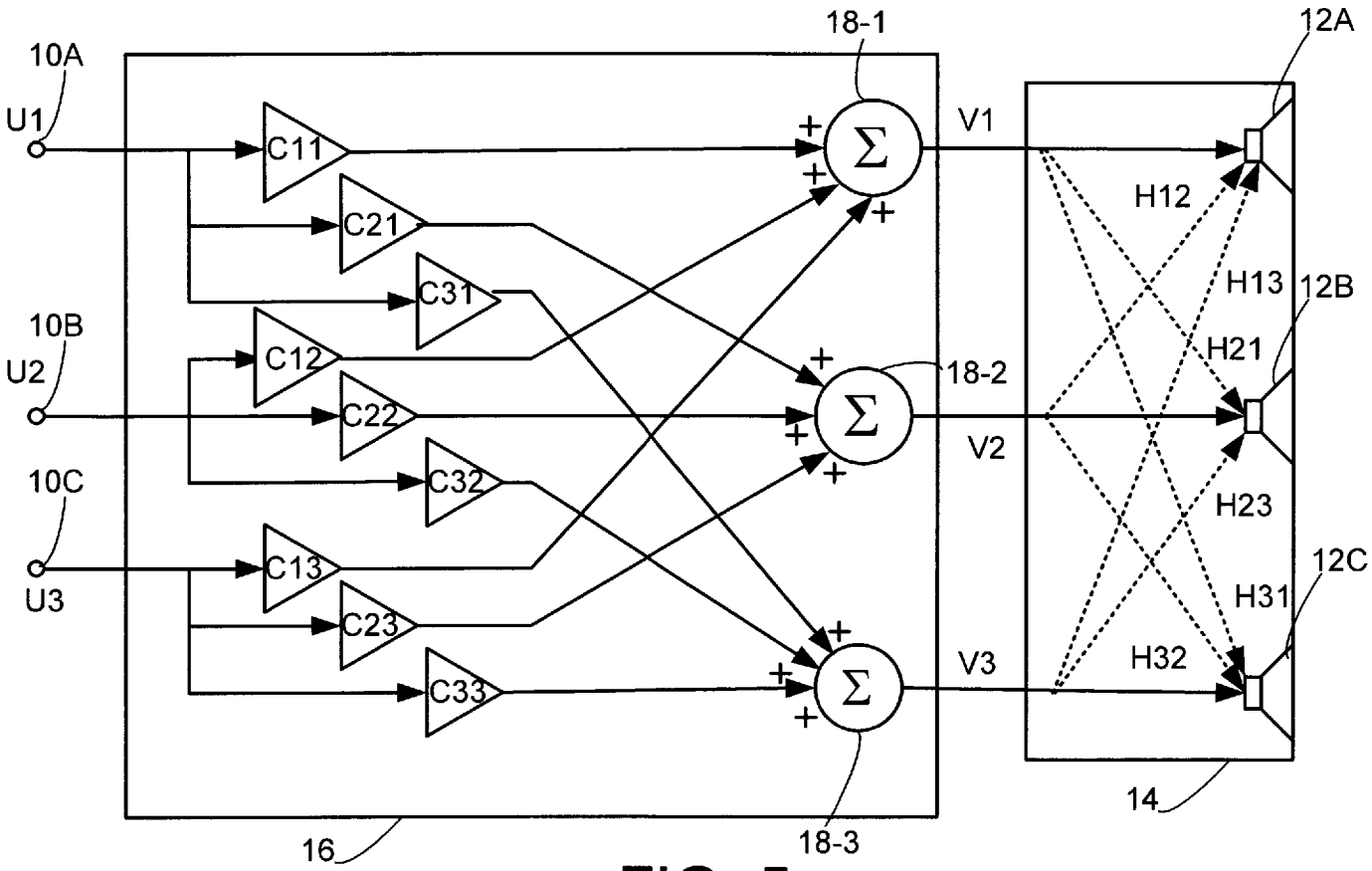
FIG. 5 is a block diagram of an audio system having three transducer.

FIG. 5 shows an implementation with three acoustic drivers, 12A, 12B, and 12C, three input signals, 10A, 10B, and 10C, sharing a common enclosure 14. This implementation includes the elements of FIG. 3, and in addition there are canceling transfer functions $C_{31}$, $C_{32}$, and $C_{33}$, coupling input signals $U_1$, $U_2$, and $U_3$, respectively, with a summer 18C, canceling transfer function $C_{13}$ coupling input signal $U_3$ with summer 18A, and canceling transfer function $C_{12}$ coupling input signal $U_3$ with summer 18B. Summer 18C is coupled to acoustic driver 12C.

Again, the system can be described in matrix notation:

$$\begin{bmatrix} H_{11} & H_{12} & H_{13} \\ H_{21} & H_{22} & H_{23} \\ H_{31} & H_{32} & H_{33} \end{bmatrix} \cdot \begin{bmatrix} C_{11} & C_{12} & C_{13} \\ C_{21} & C_{22} & C_{23} \\ C_{31} & C_{32} & C_{33} \end{bmatrix} = \begin{bmatrix} T_{11} & T_{12} & T_{13} \\ T_{21} & T_{22} & T_{23} \\ T_{31} & T_{32} & T_{33} \end{bmatrix}$$

The solution is $$\begin{bmatrix} C_{11} & C_{12} & C_{13} \\ C_{21} & C_{22} & C_{23} \\ C_{31} & C_{32} & C_{33} \end{bmatrix} = \frac{1}{\det H} \cdot \begin{bmatrix} H_{22} \cdot H_{33} - H_{23} \cdot H_{32} & -H_{12} \cdot H_{33} + H_{13} \cdot H_{32} & H_{12} \cdot H_{23} - H_{13} \cdot H_{22} \\ -H_{21} \cdot H_{33} + H_{23} \cdot H_{31} & H_{11} \cdot H_{33} - H_{13} \cdot H_{31} & -H_{11} \cdot H_{23} + H_{13} \cdot H_{21} \\ H_{21} \cdot H_{32} - H_{22} \cdot H_{31} & -H_{11} \cdot H_{32} + H_{12} \cdot H_{31} & H_{11} \cdot H_{22} - H_{12} \cdot H_{21} \end{bmatrix} \cdot \begin{bmatrix} T_{11} & T_{12} & T_{13} \\ T_{21} & T_{22} & T_{23} \\ T_{31} & T_{32} & T_{33} \end{bmatrix}$$

With $$\det H = H_{11} \cdot H_{22} \cdot H_{33} - H_{11} \cdot H_{23} \cdot H_{32} - H_{21} \cdot H_{12} \cdot H_{33} + H_{21} \cdot H_{13} \cdot H_{32} - H_{31} \cdot H_{12} \cdot H_{23} - H_{31} \cdot H_{13} \cdot H_{22}$$

The final solutions for the elements of C are lengthy terms that are not shown here.

The derivation of cancellation transfer functions for implementations with three acoustic drivers sharing the same enclosure can be applied to implementations with more than three acoustic drivers.

The elements of H are determined using a cone displacement or velocity measurement. Laser vibrometers are particularly useful for this purpose because they require no physical contact with the cone's surface and do not affect its mobility. The laser vibrometer outputs a voltage that is proportional to the measured velocity or displacement.

For an enclosure with two acoustic drivers, transfer function $H_{11}$ is measured by connecting two power amplifiers (not shown) to the two acoustic drivers and driving acoustic driver 12A with the measurement signal. Acoustic driver 12B is connected to its own amplifier that is powered up but which does not get an input signal. The laser vibrometer measures the cone motion of acoustic driver 12A. Transfer function $h_{12}$ is measured by using the same setup and directing the laser at Driver 2.

The same technique can be used to measure transfer function $H_{xy}$, in a system with y acoustic drivers by causing acoustic driver y to transduce an audio signal and measuring the effect on acoustic driver x using the laser vibrometer.

Transfer function $H_{22}$ is measured like transfer function $H_{11}$, only that now the amplifier of acoustic driver 12A has no input signal and acoustic driver 12B gets the measurement signal. Transfer function $H_{21}$ is then determined by directing the laser vibrometer at acoustic driver 12A again while exciting acoustic driver 12B.

Figure 6:
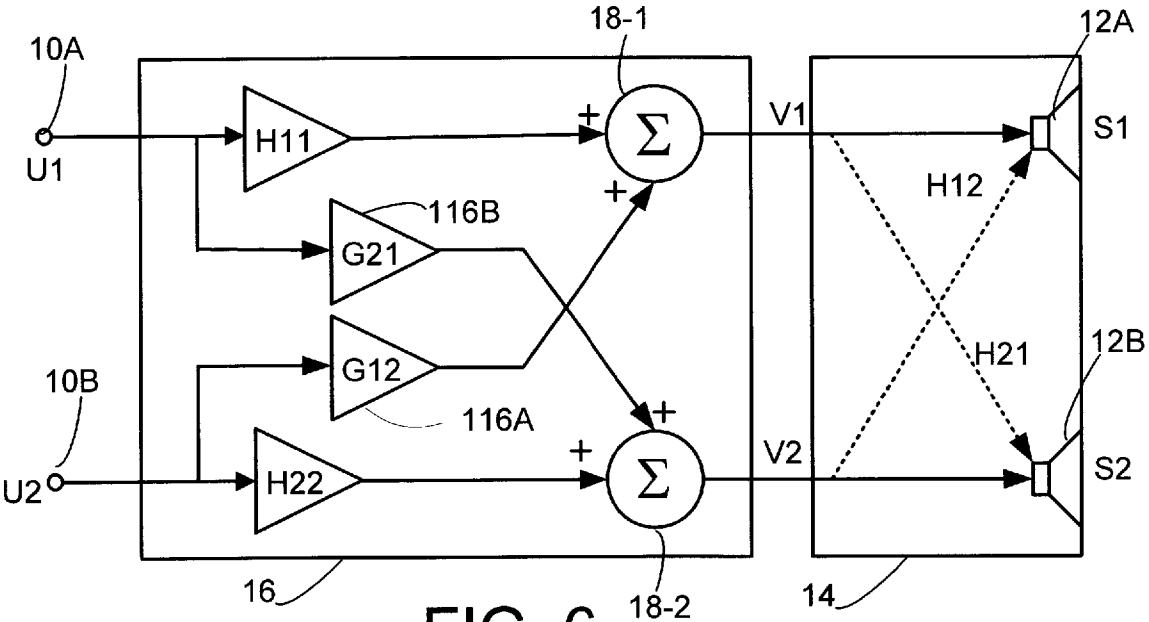
FIG. 6 is a block diagram of an alternate configuration of an audio system having a cross-coupling canceller.

A simpler system for the compensation of cross-talk in an enclosure includes adding a phase inverted transfer function of voltage $U_1$ to velocity $S_2$ to the input voltage of Acoustic driver 12B. This solution is shown in FIG. 6. The embodiment of FIG. 5 is similar to the embodiment of FIGS. 2 and 3, but does not have the cancellation adjuster 15. The conventional signal processor 17 of FIG. 2 is not shown in FIG. 5.

In the implementation of FIG. 6, canceller 16 includes a first filter 116A, coupling audio signal source 10A and summer 18-2, and a second filter 116B coupling audio signal source 10B and summer 18-1. In the embodiment of FIG. 2, the movement $S_1$ and $S_2$ of acoustic drivers 12A and 12B, respectively, in the absence of filters 116A and 116B can be expressed as $$S_1=U_2 \cdot H_{12}+U_1 \cdot H_{11} \quad (1)$$

$$S_2=U_1 \cdot H_{21}+U_S \cdot H_{22} \quad (2)$$

now we can define functions based on the transfer functions $H_{12}$, $H_{21}$, $H_{11}$ and $H_{22}$ as:

$$G_{12}=\frac{H_{12}}{H_{11}} \text{ and } G_{21}=\frac{H_{21}}{H_{22}}$$

and apply $G_{21}$ at filter 116A and $G_{12}$ at filter 116B, resulting in modified movements $S'_1$ and $S'_2$ as:

$$S'_1=S_1-U_2 \cdot G_{12} \cdot H_{11}$$

$$S'_2=S_2-U_1 \cdot G_{21} \cdot H_{22}.$$

Substituting equations (1) and (2) for $S_1$ and $S_2$ respectively gives $$S'_1=U_2 \cdot H_{12}+U_1 \cdot H_{11}-U_2 \cdot \frac{H_{12}}{H_{11}} \cdot H_{11}$$

and $$S'_2=U_1 \cdot H_{12}+U_2 \cdot H_{22}-U_2 \cdot \frac{H_{12}}{H_{22}} \cdot H_{22}.$$

The first and third terms cancel, resulting in $$S'_1=U_1 \cdot H_{11} \text{ and}$$

$$S'_2=U_2 \cdot H_{22},$$

Which means that the cross-coupling effects have been eliminated.

The system of FIG. 6 provides close results (typically within 1 dB) in the common case in which the cone motion induced by cross-coupling is small relative to the cone motion induced by the direct signal and/or in the case in which the acoustic drivers are nearly identical, which is often the case of the elements of a directional array. In the case of directional arrays, experiments suggest that the cross-talk terms in the matrix Hare in the order of −10 dB. Usually the signal of the canceling transducer is attenuated by 3 to 10 dB. The system of FIG. 6 is substantially equivalent to the system disclosed in U.S. patent application Ser. No. 11/499,014.

Figure 7:
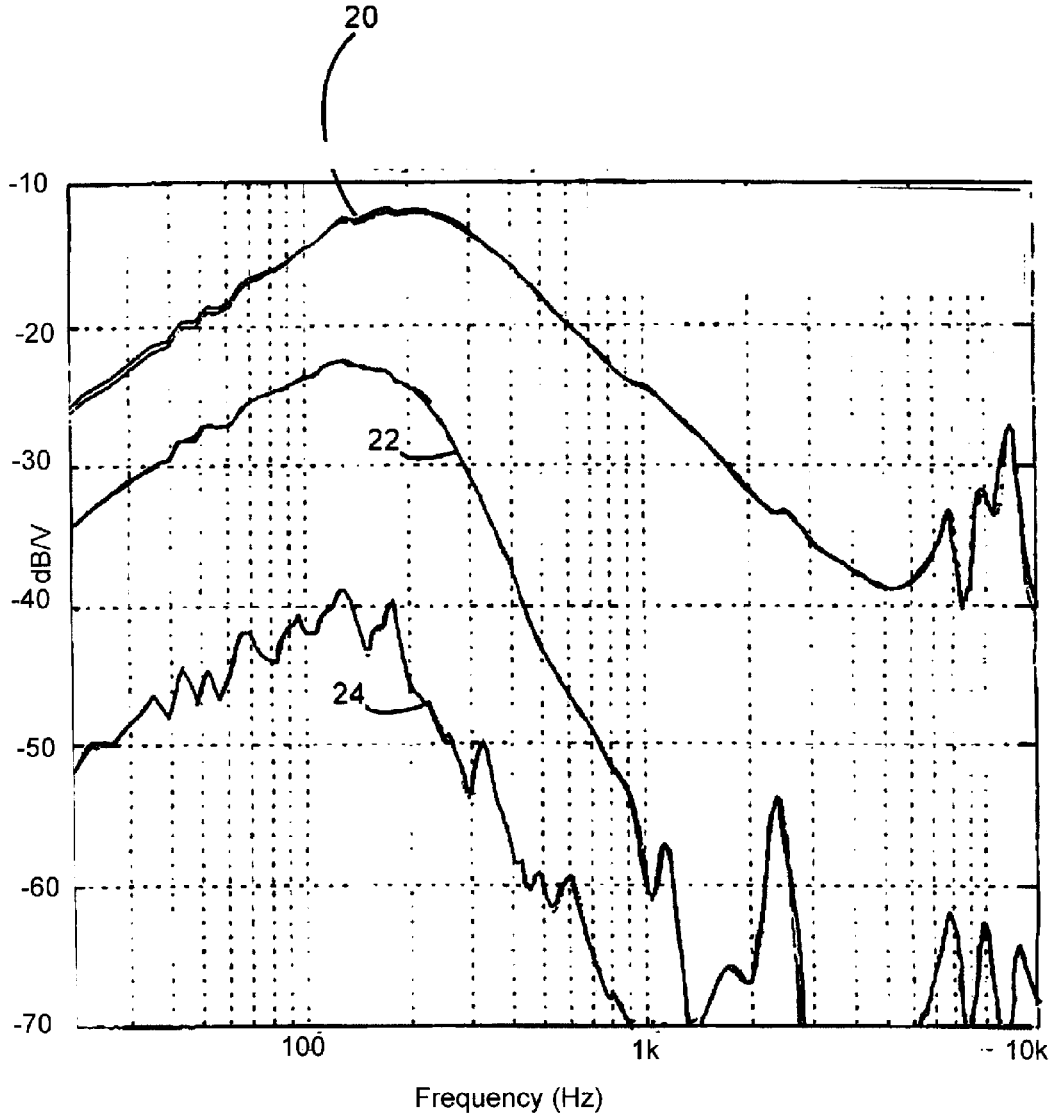
FIG. 7 is s plot of cone velocity vs. frequency.

FIG. 7 shows measurements illustrating the effect of the canceller. Curve 20 is the cone velocity of a primary acoustic driver. (Curve 20 is substantially identical with the canceller 16 in operation as it is with the canceller 16 not in operation.) Curve 22 shows the cone velocity of a secondary driver without the canceller 16 in operation, essentially showing the cross-coupling effect. Curve 24 shows the cone velocity of the secondary acoustic driver with the canceller 16 in operation. Curve 24 is approximately 10 to 20 dB less than curve 22, indicating that the canceller reduces the effect of the cross-coupling by 10 to 20 dB.

Figure 8:
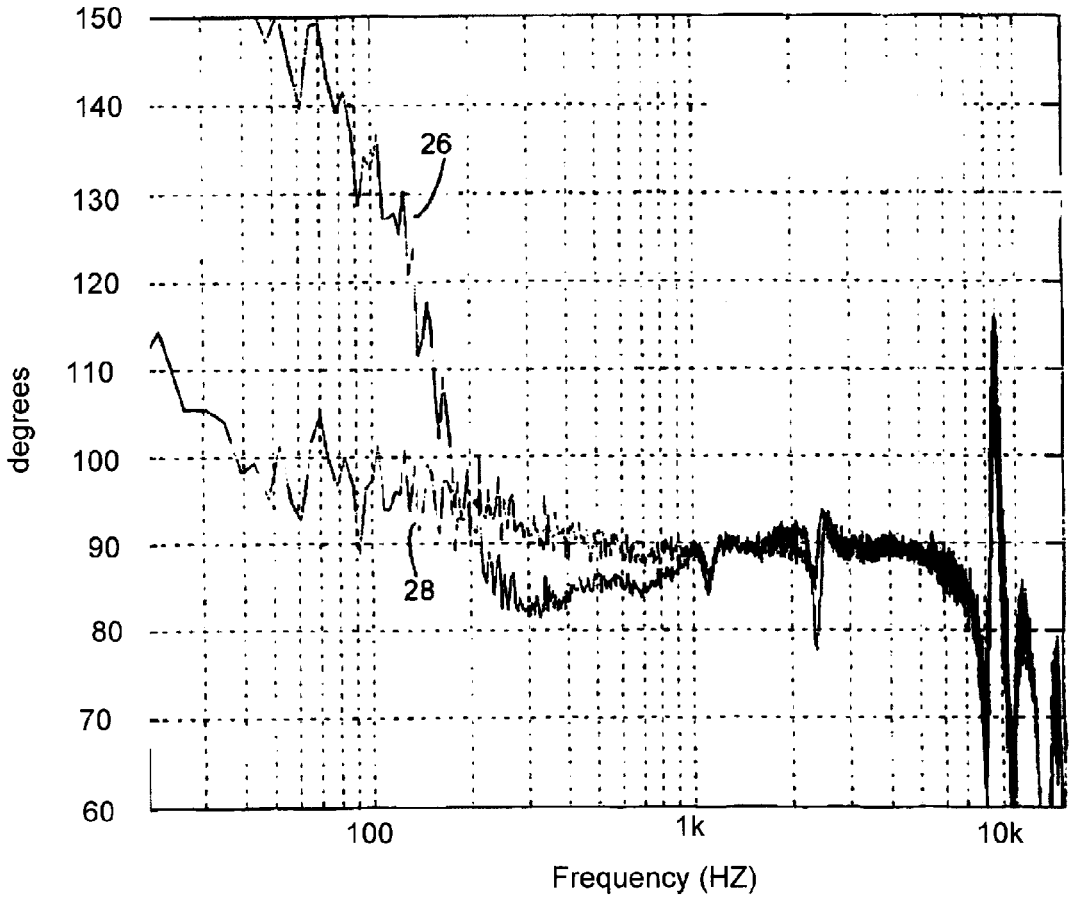
FIG. 8 is a plot of phase vs. frequency.

FIG. 8 shows the effect on phase of canceller 16. In the test illustrated in FIG. 7, it is assumed that a constant phase difference of 90 degrees is to be maintained across the entire frequency range. The 90 degree phase shift can be created by filtering the signal with a Hilbert transform. Curve 26 shows the phase difference between the cone velocity of a primary driver and the cone velocity of a secondary driver with the canceller 16 not operating and with a Hilbert transform introduced into the secondary path. Below resonance (for this system approximately 190 Hz), the phase difference varies significantly from 90 degrees. Curve 28 shows the phase difference between the cone velocity of a primary driver and the cone velocity of a secondary driver with the canceller 16 operating and with a Hilbert transform introduced into the secondary path. The phase difference varies from 90 degrees by less than 10 degrees over most of the range of operation of the audio system.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. Apparatus comprising:

an acoustic enclosure;

a plurality of acoustic drivers mounted in the acoustic enclosure so that motion of each of the acoustic drivers causes motion in each of the other acoustic drivers;

a canceller, to cancel the motion of each of the acoustic drivers caused by motion of each of the other acoustic drivers; and a cancellation adjuster, to cancel the motion of each of the acoustic drivers resulting from the operation of the canceller, wherein the cancellation adjuster applies the transfer function matrix $$\begin{bmatrix} H_{11} & \dots & H_{1n} \\ & \vdots & \\ H_{n1} & \dots & H_{nn} \end{bmatrix}$$

where each of the matrix elements $H_{xy}$ represents a transfer function from an audio signal $V_x$ applied to the input of acoustic driver x to motion represented by velocity $S_y$ of acoustic driver y.

2. The apparatus of claim 1, wherein the cancellation adjuster adjusts for undesirable phase and frequency response effects that result from the operation of the canceller.

3. The apparatus of claim 1, wherein the acoustic drivers are a components of a directional array.

4. The apparatus of claim 1, wherein the acoustic drivers are components of a two-way speaker.

5. The apparatus of claim 1 wherein one of both of the canceller and the cancellation adjuster performs signal processing not related to cross-coupling cancellation.

6. A method of operating a loudspeaker having at least two acoustic drivers in a common enclosure, comprising:

determining the effect of the motion of a first acoustic driver on the motion of a second acoustic driver;

developing a first correction audio signal to correct for the effect of the motion of the first acoustic driver on the motion of the second acoustic driver;

determining the effect on the motion of the first acoustic driver of the transducing of the correction audio signal by the second acoustic driver; and developing a second correction audio signal to correct for the effect on the motion of the first acoustic driver of the transducing of the first correction audio signal by the second acoustic driver wherein the second correction audio signal is $$\frac{1}{\det H},$$

where H is the transfer function matrix $$\begin{bmatrix} H_{11} & \dots & H_{1n} \\ & \vdots & \\ H_{n1} & \dots & H_{nn} \end{bmatrix}$$

where the matrix elements $H_{xy}$ represent the transfer function from an audio signal $V_x$ applied to the input of acoustic driver x to motion represented by velocity $S_y$ of acoustic driver y.

7. The method of claim 6, wherein the correction audio signal corrects the frequency response and the phase effects on the motion of the first acoustic driver of the transducing of the correction audio signal by the second acoustic driver.

8. The method of claim 6, further comprising determining matrix elements $H_{xy}$ by causing acoustic driver y to transduce an audio signal, and measuring the effect on acoustic driver x of the transducing by acoustic driver y by a laser vibrometer.

9. The method of claim 6, wherein the motion of acoustic driver is represented by a displacement.

* * * * *